US005480290A

United States Patent [19]

Zelder

[11] Patent Number: 5,480,290

[45] Date of Patent: Jan. 2, 1996

[54] SUBMERSIBLE MOTOR-DRIVEN PUMP

[75] Inventor: Manfred Zelder, Bonn, Germany

[73] Assignee: Wilo GmbH, Dortmund, Germany

[21] Appl. No.: 260,175

[22] Filed: Jun. 14, 1994

[30] Foreign Application Priority Data

Jun. 14, 1993 [DE] Germany ..... 43 19 619.5

[51] Int. Cl.[6] ..... F04B 39/06

[52] U.S. Cl. ..... 417/366; 417/423.3

[58] Field of Search ..... 417/366, 368, 417/369, 370, 423.3, 423.8, 424.1

[56] References Cited

U.S. PATENT DOCUMENTS

| | | | |
|---|---|---|---|
| 3,135,213 | 6/1964 | Smith et al. | 417/423.3 |
| 3,653,785 | 4/1972 | Dahlgren et al. | 417/423.8 |
| 5,332,369 | 7/1994 | Jensen | 417/423.8 |

FOREIGN PATENT DOCUMENTS

| | | | |
|---|---|---|---|
| 0467282 | 1/1992 | European Pat. Off. . | |
| 531267 | 3/1993 | European Pat. Off. . | |
| 900233 | 7/1970 | Germany . | |
| 62691 | 1/1982 | Japan | 417/423.8 |

OTHER PUBLICATIONS

Patent Abstracts of Japan, vol. 10, No. 176 (M–491) June 20, 1986, JP–A–61 025 988 (Hitachi) Feb. 5, 1986.

*Primary Examiner*—Richard A. Berisch
*Assistant Examiner*—William Wicker
*Attorney, Agent, or Firm*—Herbert Dubno

[57] ABSTRACT

A submersible motor-driven pump which has a jacket for the motor casing through which a coolant flows, the jacket receiving a pipe with a bent inlet for discharging the coolant and which lies against the motor casing and extends the full height of the jacket from the partition between the motor casing and the pump below the motor to the top of the jacket.

4 Claims, 3 Drawing Sheets

SUBMERSIBLE MOTOR-DRIVEN PUMP

FIELD OF THE INVENTION

My present invention relates to a submersible motor-driven pump having an electric motor below which the casing of a centrifugal pump is attached, the outside of the motor casing being coaxially enclosed by a cooling jacket through which the pumping medium flows.

BACKGROUND OF THE INVENTION

It has been found that, in submersible motor driven pumps of the type described, the annular space which is bounded by the cooling jacket and through which cooling medium flows is not always completely filled by the cooling medium, the result being a reduced cooling performance. Since the motor is disposed vertically in the submersible motor-driven pump, air easily accumulates in the top zone of the annular space. Furthermore, accumulations of particles of dirt may occur which cannot get out of the annular space.

OBJECTS OF THE INVENTION

It is an object of the invention so to improve a submersible motor-driven pump of the kind specified that an optimum cooling performance is always ensured.

Another object is to provide an improved submersible pump which is free from the drawback described.

SUMMARY OF THE INVENTION

These objects are attained according to the invention by forming the discharge of the annular space of the cooling jacket by a pipe which is disposed in the annular space of the cooling jacket axis-parallel with the pump axis and extending from the partition between the pump casing and the motor to the top of the annular space.

Such a pipe, disposed inside the annular space of the cooling jacket space and forming the discharge, ensures that the cooling liquid will always be taken from the top zone of the cooling jacket or annular space, so that air, gases and particles of dirt are reliably removed. The annular space is always filled and traversed by the medium to the optimum extent, thus achieving a high and constant cooling performance. Construction and assembly are particularly simple and the external dimensions are not increased.

More particularly, advantageously the inlet of the discharge pipe faces away from the direction of flow of the cooling liquid. This reliably prevents the pipe inlet from becoming clogged.

The damming of the inlet and settling of particles of dirt are also prevented by the feature that the pipe is disposed adjacent the outside of the motor casing wall. The centrifugal effect of the cooling water hurls heavy particles outwardly past the pipe. Also according to the invention the pipe can bear against the outside of the motor wall.

Advantageously in its upper zone the cooling jacket tapers conically upwards and the conically inclined zone clamps and retains the top end of the pipe. As a result, there is no need to provide additional fixing members such as, for example, fixing clips for the pipe in the top zone. The pipe is reliably retained solely by the clamping.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
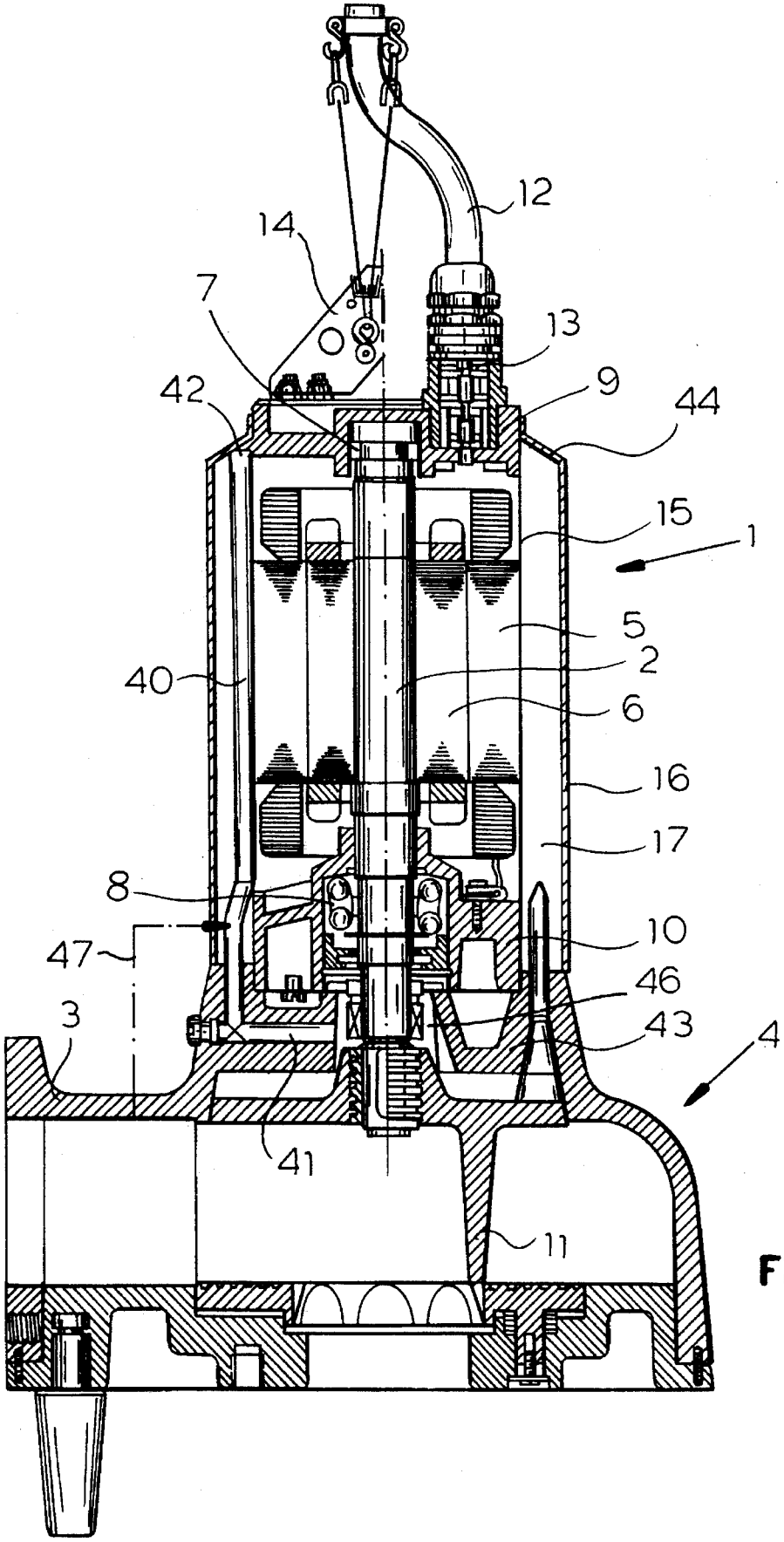
FIG. 1 is an axial section through a pump according to the invention.
Figure 3:
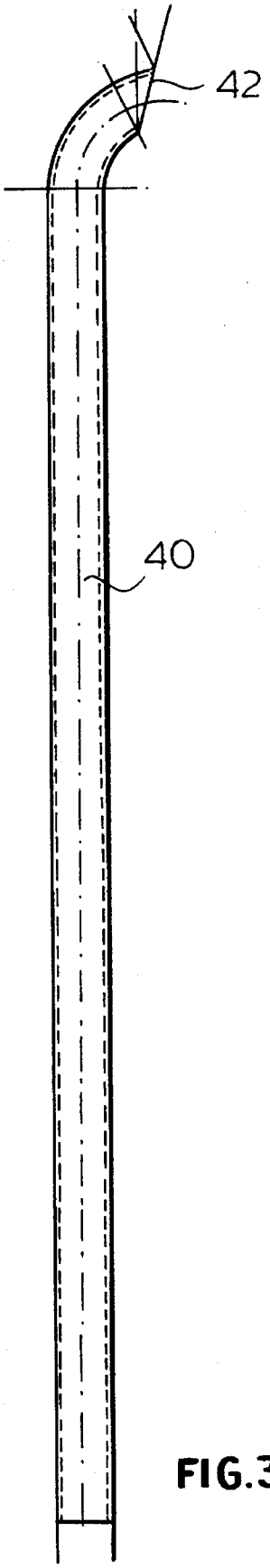
FIGS. 2 and 3 are side elevational views of the discharge pipe in two mutually perpendicular planes.
Figure 2:
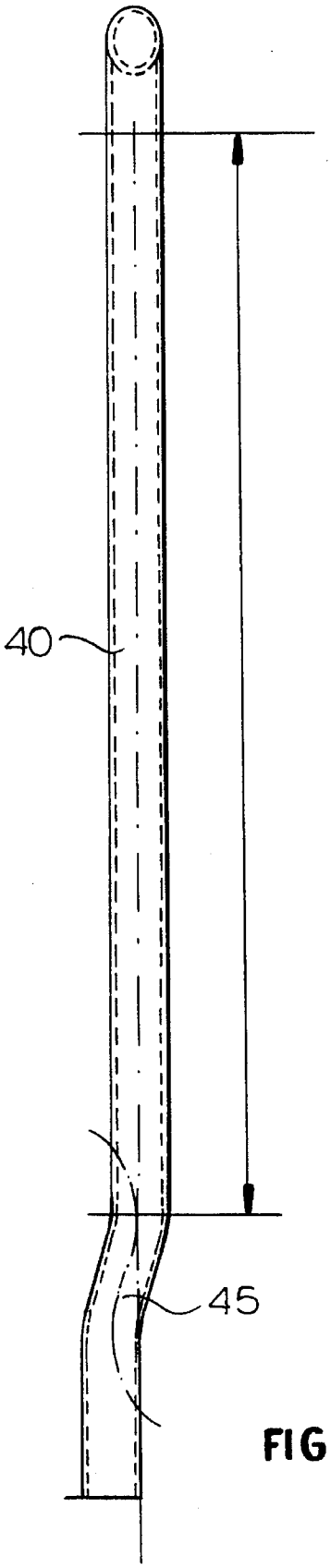

A submersible motor-driven pump has an electric motor 1 whose shaft 2 is vertical and extended downwardly into the pump casing 3 of a centrifugal pump 4. The motor 1 has a stator 5 and a rotor 6 attached to the shaft 2.

The shaft 2 is retained by a top bearing 7 and a bottom bearing 8 which are respectively attached to a top bearing flange 9 and a bottom bearing flange 10. A pump impeller 11 is mounted on the bottom end of the shaft 2.

An electric connecting cable 12 of the motor 1 extends into the motor via a cable bush 13 on its top side. Also attached to the top side of the motor is a holder 14, to enable the submersible motor-driven pump to be lifted, more particularly by a crane.

Casing 15 of the motor 1 is made of high-grade steel and produced by flow stretching. The stator 5 of the motor is forced together with the rotor 6 and further parts of the motor into the interior of the casing 15.

The bearing flanges 9, 10 are made of aluminum and can also be attached by force fit. The outside of the motor casing is coaxially enclosed by a cooling jacket 16, which therefore cooperates with the outside of the motor casing 15 to form an annular space 17. The annular space 17 is traversed by a cooling liquid, more particularly the pumped liquid, generally water, which is branched off from the pumping medium as diagrammatically represented at 47. The cooling jacket 16 is made of high-grade steel and attached to the motor by a force fit.

The pump casing is made of plastic, more particularly polyurethane. Similarly, the pump impeller 11 is also made of plastic, more particularly polyurethane.

Disposed vertically in the cooling jacket 16 is a pipe 40 which forms a discharge and is connected by its bottom end to a transverse bore 41 in a wall 43 of the pump casing 3 and which separates the motor from the pump casing. The transverse bore 41 extends to the interior 46 of the pump, in which the impeller 11 is mounted.

The top end of the pipe 40 is bent through approximately 90 degrees. The inlet opening 42 of the bent end is turned away from the direction of circulatory flow of the cooling liquid.

The pipe 40 is disposed adjacent the outside wall of the motor casing 15 and more particularly bears thereagainst. To ensure that it is disposed adjacent the outside wall of the motor casing, the pipe 40 is bent twice in the lower zone 45.

Figure 4:
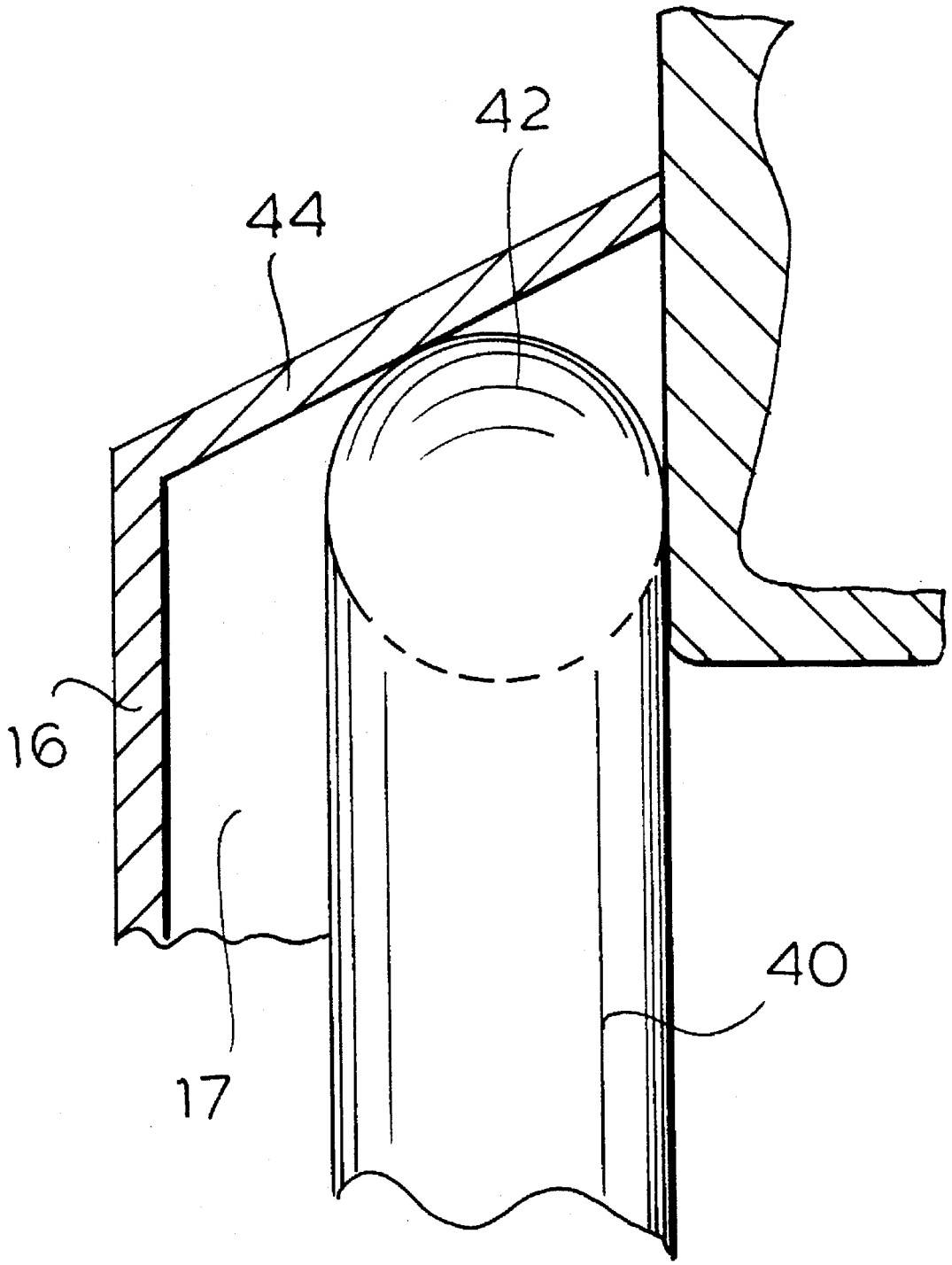
FIG. 4 is a detail section showing the conically inclined jacket portion clamping and retaining the top end of the pipe.

The upper zone of the cooling jacket 16 tapers conically upwards, the conical inclined zone 44 clamping and retaining the top end of the pipe (see FIG. 4).

I claim:

1. A submersible motor-driven pump, comprising:

a pump drive motor having a vertical axis and formed with a motor casing surrounding said axis;

a centrifugal pump driven by said motor and mounted on said motor casing below said motor;

a cooling jacket coaxially surrounding said motor casing and forming an annular space traversable by a cooling medium between a partition between said motor casing and said centrifugal pump and a top of said annular space the cooling medium moving in said annular space in a circulatory direction of flow; and a pipe in said annular space for discharge of said cooling medium from said annular space, said pipe extending from said partition to said top of said annular space, said pipe having a bent inlet facing away from said circulatory direction of flow of the cooling medium.

2. The submersible motor-driven pump defined in claim 1 wherein said pipe is disposed adjacent an outside of said motor casing.

3. A submersible motor-driven pump, comprising:

a pump drive motor having a vertical axis and formed with a motor casing surrounding said axis;

a centrifugal pump driven by said motor and mounted on said motor casing below said motor;

a cooling jacket coaxially surrounding said motor casing and forming an annular space traversable by a cooling medium between a partition between said motor casing and said centrifugal pump and a top of said annular space the cooling medium moving in said annular space in a circulatory direction of flow; and a pipe in said annular space for discharge of said cooling medium from said annular space, said pipe extending from said partition to said top of said annular space, said pipe having a bent inlet facing away from said circulatory direction of flow of the cooling medium, said pipe being disposed adjacent an outside of said motor casing and bearing against said outside of said motor casing.

4. A submersible motor-driven pump, comprising:

a pump drive motor having a vertical axis and formed with a motor casing surrounding said axis;

a centrifugal pump driven by said motor and mounted on said motor casing below said motor;

a cooling jacket coaxially surrounding said motor casing and forming an annular space traversable by a cooling medium between a partition between said motor casing and said centrifugal pump and a top of said annular space; the cooling medium moving in said annular space in a circulatory direction of flow; and a pipe in said annular space the cooling medium moving in said annular space in a circulatory direction of flow for discharge of said cooling medium from said annular space, said pipe having a bent inlet facing away from said circulatory direction of flow of the cooling medium said pipe extending from said partition to said top of said annular space, said jacket tapering conically upwardly at said top and a conically inclined portion of said jacket clamps and retains a top end of said pipe.

* * * * *